US010106940B1

(12) United States Patent
Tang et al.

(10) Patent No.: US 10,106,940 B1
(45) Date of Patent: Oct. 23, 2018

(54) SPIKE STRIP

(71) Applicants: Quanyong Tang, Beijing (CN); Xuebing Tang, Beijing (CN)

(72) Inventors: Quanyong Tang, Beijing (CN); Xuebing Tang, Beijing (CN)

( * ) Notice: Subject to any disclaimer, the term of this patent is extended or adjusted under 35 U.S.C. 154(b) by 0 days.

(21) Appl. No.: 15/478,089

(22) Filed: Apr. 3, 2017

(51) Int. Cl.
*E01F 13/12* (2006.01)

(52) U.S. Cl.
CPC ..... *E01F 13/12* (2013.01)

(58) Field of Classification Search
CPC ..... E01F 13/12
See application file for complete search history.

(56) References Cited

U.S. PATENT DOCUMENTS 1,276,100 A * 8/1918 Niznik ..... E01F 13/12 160/127
3,456,920 A * 7/1969 Elvington ..... E01F 13/12 256/1
5,536,109 A * 7/1996 Lowndes ..... E01F 13/04 256/1
5,611,408 A * 3/1997 Abukhader ..... E01F 13/12 180/287
5,839,849 A * 11/1998 Pacholok ..... B60R 25/00 404/6
6,048,128 A * 4/2000 Jones, III ..... E01F 13/12 256/13.1
6,527,475 B1 * 3/2003 Lowrie ..... E01F 13/12 180/287
7,210,875 B1 * 5/2007 Christle ..... E01F 13/12 404/6
7,220,076 B2 * 5/2007 Boll ..... B60R 25/096 180/287
7,275,889 B1 * 10/2007 McGill ..... E01F 13/12 404/6
7,377,715 B2 * 5/2008 Kruise ..... E01F 13/12 404/6
7,850,392 B2 * 12/2010 Schubert ..... E01F 13/12 404/6
8,011,850 B1 * 9/2011 Perlsweig ..... E01F 13/12 160/351
8,132,980 B1 * 3/2012 Lee ..... E01F 13/12 180/287
8,147,163 B2 * 4/2012 Bare ..... E01F 13/12 404/6
8,517,625 B2 * 8/2013 McCoy ..... E01F 13/12 404/6
9,297,128 B1 * 3/2016 Tang ..... E01F 13/12
9,416,506 B2 * 8/2016 Castro ..... E01F 13/12
(Continued)

FOREIGN PATENT DOCUMENTS

GB 302453 A * 12/1928 ..... E01F 13/12
WO WO-9615417 A1 * 5/1996 ..... E01F 13/12

*Primary Examiner* — Thomas B Will
*Assistant Examiner* — Katherine J Chu
(74) *Attorney, Agent, or Firm* — Donn K. Harms

(57) ABSTRACT

A spike strip for disabling vehicle tires is provided which is deployable from a restrained configuration to an elongated configuration. The spike strip is formed from a scissor arm assembly of a plurality of arms engaged at spring loaded pivots. A restraint provides a releasable connection which may keep the spike strip collapsed or engaged with a housing or allow for a disconnected ejection. Automatic retrieval to the housing may be provided by an engaged cable system.

20 Claims, 8 Drawing Sheets

(56) References Cited

U.S. PATENT DOCUMENTS

| | | | | |
|---|---|---|---|---|
| 2010/0284739 | A1* | 11/2010 | Allsopp | E01F 13/12 404/6 |
| 2014/0119825 | A1* | 5/2014 | Castro | E01F 13/12 404/6 |

* cited by examiner

SPIKE STRIP

1. FIELD OF THE INVENTION

The present invention relates to the stopping of fleeing vehicles through the disablement of the tires and engaged wheels. More particularly the invention relates to a deployable spike strip device which deploys an expanding spiked member formed of a plurality of engaged scissor units. The spiked member, at the option of the user, can be retained in contact with a housing or ejected therefrom, and may optionally be automatically retrieved from the roadway to the housing.

2. PRIOR ART

With the massive enlargement of broadcast and streamed media and internet communication of video, there has come a significant increase in motor vehicle chases of fleeing vehicles by authorities. While such used to be an infrequent occurrence, chases of vehicles who fail to yield have become an ever more frequent problem for law enforcement. While some authorities believe the number of such chases just seems to have increased due to the increased broadcast of the constant news, other authorities believe that many fleeing drivers actually initiate a high speed or elongated chase of their vehicle by police. They do so for fleeting fame so the chase they cause is viewed on the television or internet news.

Whatever the cause, as can be discerned from viewing vehicle chases involving law enforcement officers, whether chasing criminals, or just citizens who refuse to stop, such high speed chases on city streets pose a serious threat. This threat extends to the safety and lives of the officers, the safety of a party being pursued, and especially to bystanders who may be unintentionally in the path of the chase, and unaware of the oncoming danger.

In order to encourage obedient behavior by citizens when requested to stop, it is desired to significantly reduce the number and frequency of such chases, to thereby reduce broadcast and viewing of such chases which may encourage more. Further, for the safety of all concerned, it is in the interest of law enforcement to quickly end such vehicle chases of criminals and citizens who refuse to stop. This may only be accomplished through a disabling of the movement of the vehicle being pursued by law enforcement. To minimize the potential for televising such chases, and to significantly reduce the threat of injury to law enforcement and bystanders, cessation of vehicle chases should be accomplished safely and as quickly as possible.

A long used method of law enforcement for disabling a fleeing vehicle in such chase situations noted above, is to employ a device to cause the tires of the vehicle being chased, to deflate. One well known method employed to cause such a deflation, which disables the tires and hence the wheels, and thus ceases vehicle movement, is through the employment of what is known as a spike strip.

Conventionally, such tire piercing devices employ spikes or other sharp members adapted for road positioning in an orientation adapted to puncture inflated rubber tires. Currently, such spikes are connected to elongated chains or cables which are positioned in the road at locations determined to be in front of a pursued vehicle. Such positioning of spiked devices are done with the intent that the tires of the fleeing vehicle will run across the spike strip. When this occurs, one of the hooks or spikes will usually puncture one or more tires on the pursued vehicle.

When a tire of such a fleeing vehicle contacts such a spike strip, it can be effective in deflating one or more of those tires. This will generally cause the tires to deflate and discount from the rim, thereby causing the fleeing vehicle to slow and eventually stop. Because of the many times such chases have been broadcast, quite often a driver of such a fleeing vehicle is aware that such a spike strip may be encountered, as it is a common practice and frequently filmed. As such, a fleeing driver anticipating such a deployment will frequently try to avoid the deployed spike strip.

As can be discerned, in order to puncture the tires of a fleeing vehicle, the officer or user needs to deploy the spike strip in a location in front of the oncoming vehicle of a fleeing driver. Because the fleeing driver may see and avoid the spike strip, the law officer deploying the spike strip must position the spike strip at the last moment. If this deployment is accomplished timely and properly, the fleeing driver will not see it and will be unable to avoid wheel contact with the deployed strip.

However, it is a very dangerous endeavor for law officers to deploy conventional cabled or chained strips across a roadway in front of a fleeing vehicle. During deployment, the officer must remove a conventional cabled device from storage and render it ready to be thrown to an elongated positioning in the roadway. Once properly prepared, the officer must actually move into the roadway and use their arms to throw the device in front of the fleeing driver and vehicle at the very last moment. An early deployment will allow the driver to see and avoid the spike strip. A late deployment will miss the chance to puncture the tires. However, a timely deployment also will position the officer in the roadway substantially at the same time the fleeing vehicle is speeding toward him.

As can be discerned, using conventional cabled or chain-engaged spike strips becomes a very dangerous endeavor for an officer to timely deploy in the roadway. In doing so, the officer risks being run over by the vehicle of the fleeing driver attempting to avoid the deployed spike strip. Making the task even more arduous and dangerous, most law enforcement officers are not trained or physically adept at actually throwing a bulky, cabled spike strip from a rolled or folded position, into the roadway. As a consequence, frequently they fail in their attempt at a successful unfolding and total elongation of the spike strip in the roadway.

Further, due to the dangerous circumstances of the task, law enforcement users of such spike strips, when throwing the spike strip in haste at the last moment to surprise the fleeing driver, make errors. Due to no fault of the officer, and more to the circumstances, the spike strip frequently fails to elongate and properly deploy, and thereby misses the proper positioning to disable the tires and wheels of a fleeing vehicle.

If the danger from use were not enough of an issue, frequently, when the tires of a fleeing vehicle do run over conventional spike strips, that contact will frequently destroy or render the spike strip useless for future attempts. Such disablement comes from the fact that conventional spike strips are frequently cabled or chain based. Being flexible and elongated they tend to wind around rolling tires and wheels and axles of the vehicle. The force of such an engagement is generally sufficient to tear the spike strip to shreds.

If the spikes successfully impale the tire and disable the wheel, it may be worth the cost of a destroyed spike strip. Unfortunately, because of the unpredictable deployment of such strips due to their cabled or chain or flexible make up, many times the spikes miss their mark and the spike strip is still destroyed from being wound round the moving wheel and tire and ripped apart by the massive torque and force.

As a consequence, there exists a continuing unmet need for a spike strip device which is configured to remedy the noted shortcomings of conventionally deployed spike strip devices. To that end, such a spike strip device and method should allow for a remote controlled ejection of a spike strip by an officer in front of an approaching vehicle at the last possible moment. In doing such, the officer should be able to operate the device from a safe distance so as to protect officer safety. Such a device should be deployable in an instant, at the last possible moment, in order to eliminate a view of the deployed device by the driver.

Still further, such a device should be configured with optional configurations yielding user chooseable deployments of the spike strip, and whether it separates from the housing holding it, and whether it is automatically retrieved or retrieved by hand.

Still further, such a spike strip device, when remotely deployed from a safe position, and once it has speared the tires of a fleeing vehicle with spikes, should be easily stowed and should be easily rendered fit for a subsequent use by easy replacement of the spikes which have been speared into the vehicle tires.

The forgoing examples of related art and limitations related therewith are intended to be illustrative and not exclusive, and they do not imply any limitations on the invention and method described and claimed herein. Various limitations of the related art are already or will become apparent to those skilled in the art upon a reading and understanding of the specification below and the accompanying drawings.

SUMMARY OF THE INVENTION

The spiked strip device and method herein disclosed and described, yields numerous solutions to the shortcomings in prior art in spike strip configuration and deployment. The disclosed device in various modes achieves the above noted goals through the provision of a spike strip device formed as a collapsible member formed of a plurality of planar members in scissor-like engagements. These engagements define individual spring loaded scissor units which make up a scissor arm assembly forming the body of the device.

The total length of the deployable formed planar scissor arm assembly of the spike strip is dependant on the number of scissor units from which it is composed. Because of the spring loaded pivots formed with each of the scissor units, the scissor arm assembly, when collapsed, is biased to expand once released.

The disclosed spike strip device herein, employs this planar scissor arm assembly formed of a plurality of operatively engaged spring loaded scissor units, of pivotally engaged arms, yield a spike strip which has a very small sized compacted mode during storage. The length of the scissor arm assembly stored in a housing or held by a triggered mechanism, is a small fraction of the length of the member forming the body of the spike strip in a deployed or elongated configuration.

Consequently, a ten foot spike strip while deployed to the elongated configuration of the planar scissor arm assembly forming the body of the deployed spike strip herein, when compressed will compact to a configuration of a foot or two in length.

The scissor arm assembly of pivoted arms, providing the body of the spike strip device herein, is planar on both sides of the spring loaded individual pivotally engaged shorter members forming the scissor units. The pivotally engaged members combine to form the elongated planar scissor arm assembly or body of the device. Thus, a first side of the spike strip is planar and thus complimentary to the flat surface of most roadways.

The second surface of the elongated member forming the scissor arm assembly defining the body of the device whether biased by the springs to the deployed position or held in the compacted position, is also planar. Thus, the second surface offers a planar contact surface for the tires of a fleeing vehicle to pass over. This planar surface contacting the planar surface of a rolling tire is highly unlikely to become engaged with a wheel or axle in the manner plaguing conventional spike strips.

Extending from engagements with this planar second surface, which is parallel to the roadway surface, are a plurality of spikes projecting in a perpendicular disposition to the planar member, and to the roadway when the device is in the deployed position. Thus, every spike engaged with the planar arms forming the scissor arm assembly or body, with the body expanded and deployed in a roadway, is perpendicular and positioned to pierce a vehicle tire instantly on contact with the tire.

A first end of each spike is removably engaged with the planar scissor arm assembly forming the body of the spike strip. This engagement renders the spikes easily replaced if removed during an encounter with a vehicle tire. This removable engagement can be a direct fit into apertures formed into the shorter members forming the plurality of scissor units defining the planar scissor arm assembly of the device herein. In another mode, the spikes can be engaged with annular fittings, sized to engage with complimentary apertures formed in the shorter members defining the plurality of scissor units forming the plurality of biased scissor arm assembly defining the body of the device herein.

At a plurality of pivot points on the engaged individual scissor units, a spring or other biasing means continuously forces the shorter members in a direction causing the scissor arm assembly forming the body of the device to elongate, is operatively engaged. The combined biasing force of this plurality of collapsed springs with the elongated body in the collapsed configuration, will automatically elongate as the individual members engaged at pivot points rotate. This will cause a very fast elongation of the scissor arm assembly forming the body, and quickly move it from the small compacted or collapsed size, to the elongated size of many feet or yards long.

The force of the wound springs at the pivot points, or other means to bias the scissor units in an "X" like configuration of the smaller members forming it, will cause the elongated member, when collapsed, to a configuration where the smaller members of the scissor units are parallel, to instantly expand back to the elongated position. This self-deploying biased positioning of springs at the pivot points, and instant elongation, enables the device herein expand from its housing or restraint, and thereby be easily deployed with little or no "throwing" effort by the user.

Additionally, because of the compact size of the collapsed configuration of the elongated member formed by criss-crossed scissor units, the device can be stored in a housing or held collapsed by a restraint, until deployment is desired. At that moment, the pressing of a button activating a release of the restraint or opening the housing self-deploys the elongated member. Such will cause an immediate elongated positioning of the elongated scissor arm assembly defining the body of the device, in a line substantially along an center axis of the elongated member in the collapsed position.

In this fashion, a user such as law enforcement, can position the housing holding the device in the collapsed, or the device held by a restraint in the collapsed position, on or adjacent a roadway and then move to a safe, or even hidden position. Activation of a remote control or connected release will instantaneously move to the device to the deployed and elongated position, in substantially a straight line from the housing opening, and onto the roadway. Such a deployment will position spikes or spears in a position perpendicular to the roadway where they are located to puncture an oncoming tire encountering a spike.

The device herein, where a housing retains the collapsed body formed of the pivoting members, is engaged at a trailing end of the expanding body, with a connecting member. This engagement to the connecting member enables the user to choose how the elongated body is deployed in the roadway.

The connecting member provides a selectable engagement at a center portion thereof, with one end of the body of the device. In one user configured mode, the device with user may select to maintain the connection of the trailing end of the expanding body, with the connecting member. Because the connecting member has a length which is wider than the opening in the housing through which the body of the device expands when triggered, when the connection with the connecting member is maintained after deployment, the trailing end of the body of the deployed device, will remain at or within the exit opening of the housing, and connected thereto.

The user may also configure the selectable engagement with the connecting member to release the engagement to the trailing end of the body of the device upon deployment. In this mode, the connecting member remains within the confines of the housing, and the body of the spike strip is ejected totally out of contact with the housing. This mode may work better when the spike strip needs to be located to a lane of the roadway spaced a distance from the housing location.

The connecting member, with this selectable engagement, allows for easy repositioning of the elongated deployed body of the device, back into the confines of the housing. A first connector on the body of the spike strip is configured to engage with a second connector located on the connecting member which remains centered within the confines of the housing, and thus centers the elongated body with the cavity formed in the housing. Once the first and second connector engage, the user may simply push on the leading end of the body of the spike strip, and it will collapse into the housing and remain centered by the connection of first connector on the body with the second connector on the connecting member as it slides to the rear of the cavity in the housing.

Additionally provided, is an automatic retrieval system which is enabled by this selectable connection of the body of the spike strip with the connecting member, which maintains the body centered during collapse into the housing. The automatic retrieval employs a cable which on a first end is engaged to a spool, and on a second end, connects with the leading end of the body of the spike strip. This cable also is engaged through an opening or guide in the central area of the connecting member which is most important to maintain alignment of the components during use, and to enable automatic retrieval without binding of the cable. The cable can also provide a release for the device to deploy the spike strip, by actuating a release on the spool to let it free-wheel. Such will release the compressive force of the cable against the collapsed body of the spike strip, which will immediately elongate from the force of the plurality of springs engaged thereto.

Once the body of the spike strip has been deployed, winding the cable on the spool, with cause the automatic retrieval and repositioning of the body of the spike strip, back into the housing, in the collapsed position. It can be held in this collapsed position by the cable, until the reel is subsequently released to free-wheel.

In modes of the device which have the connecting member but do not use a cable and spool, the release from the confines of the housing is controlled by a release which opens the door covering the cavity of the housing, and against which the collapsed body of the spike strip compresses. This release can be electronic and remote such as by employing an electric powered solenoid to unlock the door, or can be accomplished by hand activation by pulling or pushing a release to unlock the door. Once released, the body of the spike strip will either deploy into the roadway and separate from the connecting member, or remain connected to it, depending on how the user has configured the selectable engagement.

The device may be configured also for deployment from a vehicle rather than the side of the roadway. All modes of deployment noted above are available, depending on whether a cable is present and whether the selectable engagement holds the body of the device to the connecting member or releases it during deployment.

When deployed from a vehicle such as a police car, a tilting base can be used to cause the housing to slide from the vehicle to the road surface. Thereafter the release is remotely controlled to either open the door of the housing when a cable is not present for automatic retrieval, or release of the spool for the cable to free wheel when it is present.

In yet another mode of the device and system herein, the hosing may be replaced with a restraining member, which is configured to hold the body of the spike strip in the collapsed position. This restraint member is released from holding the body in the collapsed position by an impact trigger as the device is deposited on the roadway. This mode of the system will work well with aircraft deployment such as from a helicopter or drone.

With respect to the above description, before explaining at least one preferred embodiment of the herein disclosed spike strip device and method in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed spike strip device and method. It is important, therefore, that the claims be regarded as including such equivalent construction and methodology insofar as they do not depart from the spirit and scope of the present invention.

As used in the claims to describe the various inventive aspects and embodiments, “comprising” means including, but not limited to, whatever follows the word “comprising”. Thus, use of the term “comprising” indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a spike strip device which may be easily deployed remotely with no throwing effort required by the user.

It is an object of the invention to provide such a spike strip device which moves from a collapsed position to an elongated position as it ejects from a housing to which it may remain engaged or be released at the user option.

It is another object of the invention to facilitate the employment of remote control for deployment and allow the user to hide so as not to warn a fleeing driver.

It is another object of the invention provide a spike strip device, which may be automatically retrieved back into a housing and constrained until a subsequent release automatically.

These and other objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the spike strip device and method herein. It is intended that the embodiments and figures disclosed herein are to be considered illustrative rather than limiting. In the drawings.

Figure 1:
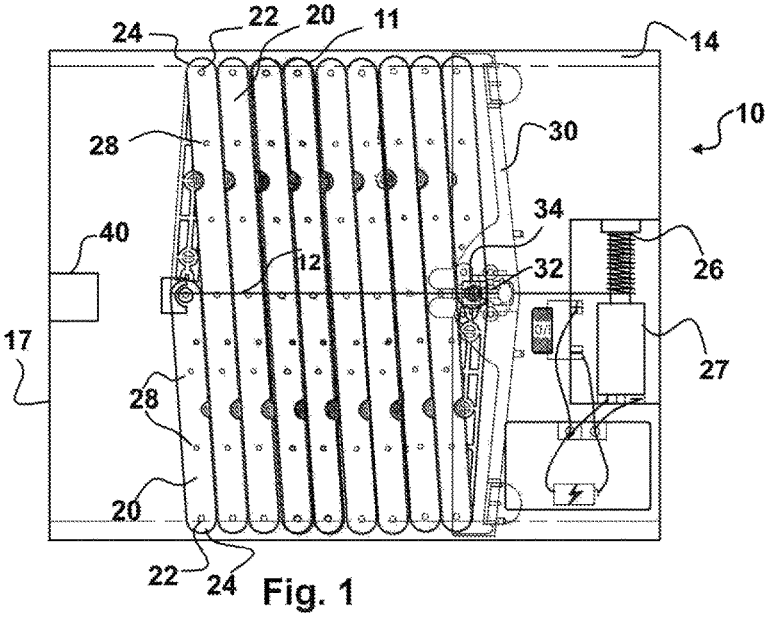
FIG. 1 shows a top view of a particularly preferred mode of the spike strip device held with the scissor arm assembly defined by the body of the device, in a collapsed mode within housing by a cable.
Figure 2:
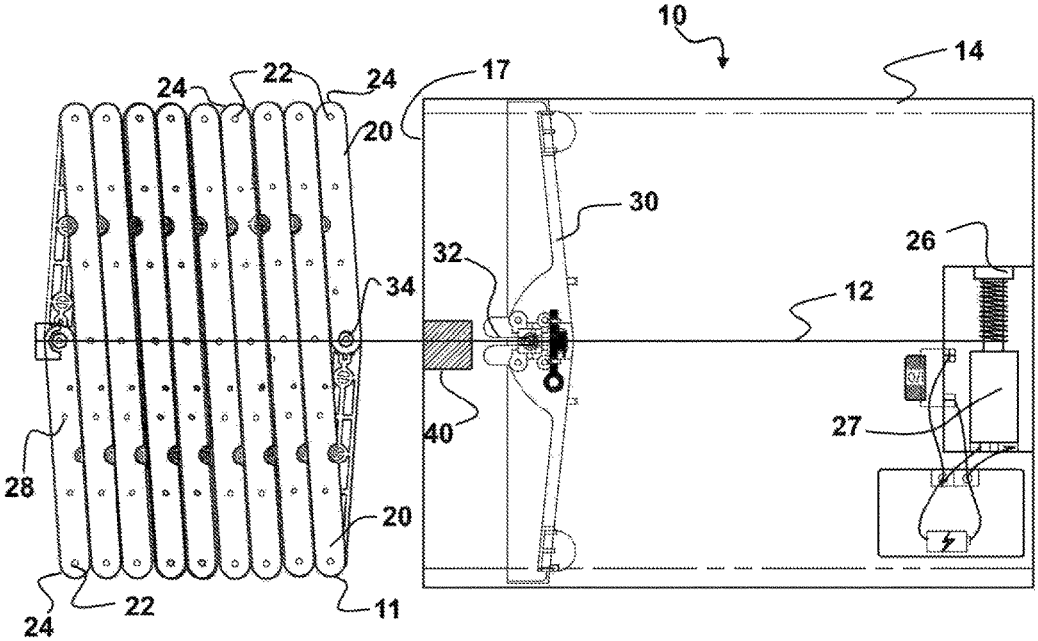
FIG. 2 shows a view of the device of FIG. 1, subsequent to release from the housing showing the cable positioned to automatically retrieve the spike strip and collapse it from an elongated configuration, back to the configuration of FIG. 1.
Figure 2A:
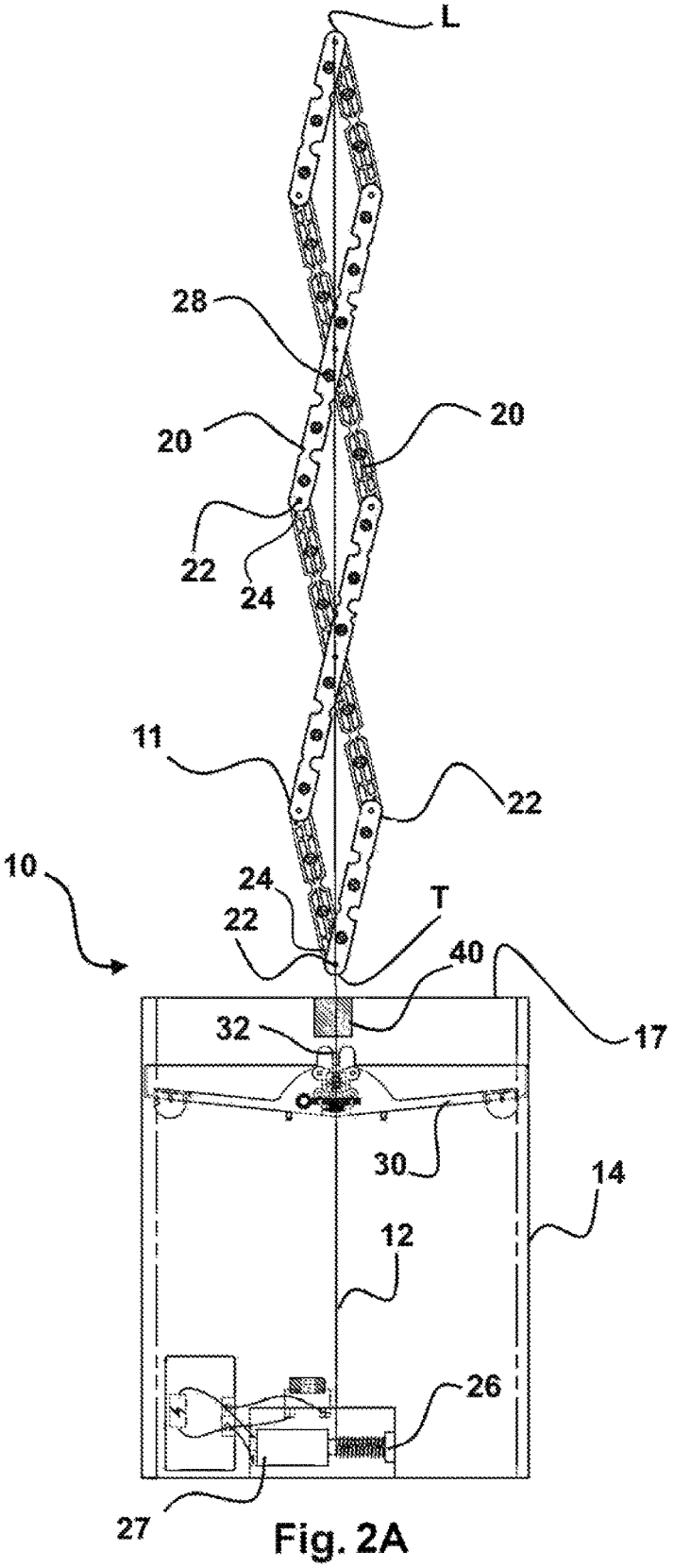

FIG. 2*a* depicts the device of FIG. 1, deployed to the elongated position from the housing in a configuration where the tail end disconnects from the connecting member which remains in the housing.

Figure 3:
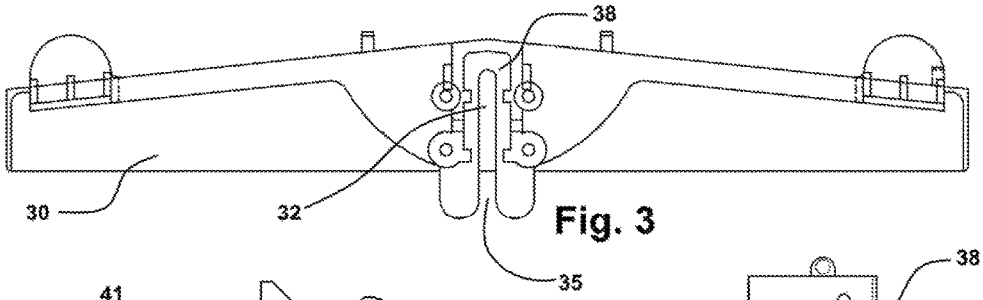

FIG. 3 is a top plan view of the connecting member shown in the figures and showing the centrally located first connector adapted for selectable engagement with the trailing end of the body of the spike strip.

Figure 3A:
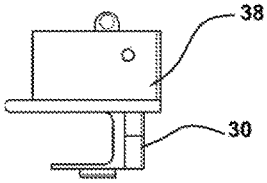

FIG. 3A shows a side view of the connecting member of FIG. 3, and shows an opening for engagement of a pin to hold the first connector on the connecting member engaged with the second connector on the trailing end of the spike strip.

Figure 3B:
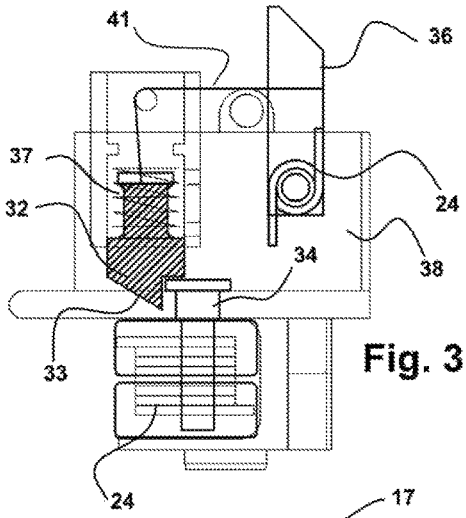

FIG. 3B shows a sectional view through a central portion of the connecting member, showing a lever in a first position, engaged with the first connector on the connecting member which is engaged to the second connector of the body of the spike strip.

Figure 4:
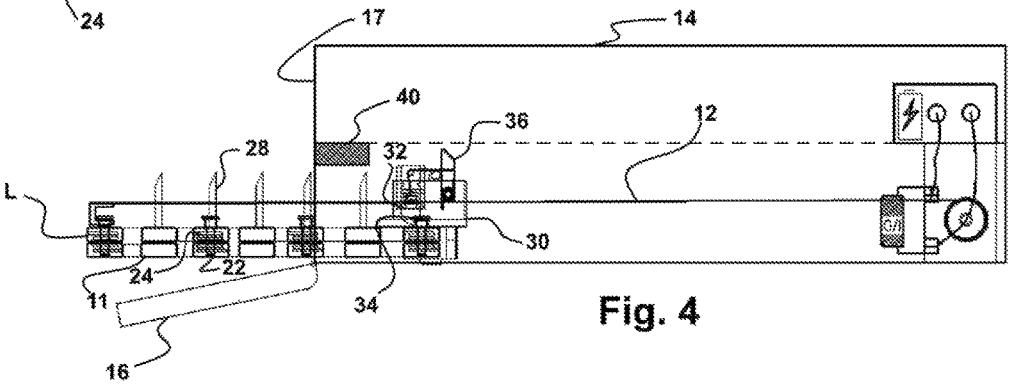
Figure 5:
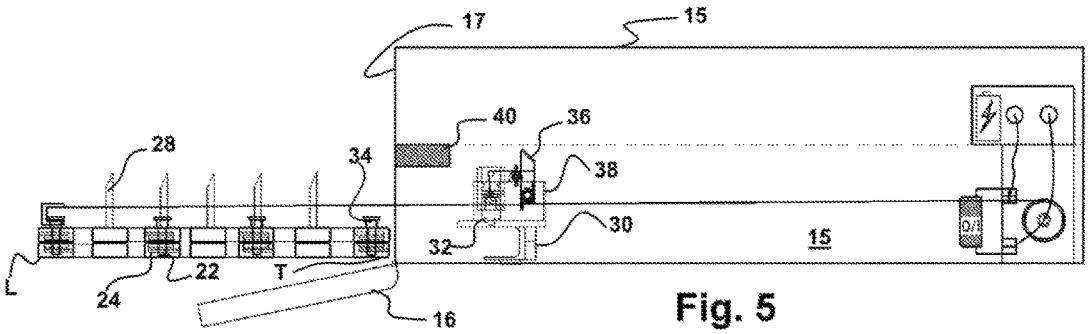

FIG. 4 shows the device configured as in FIG. 2, where the lever is in a first position which will actuate a release of the first connector from the second connector and disengage the body of the spike strip on deployment shown in FIG. 5.

FIG. 5 shows the disengaged spike trip ejecting from the cavity of the housing from the force of the compression springs and showing the cable engaged to the leading end of the body and an aligning opening on the connecting member.

Figure 6:
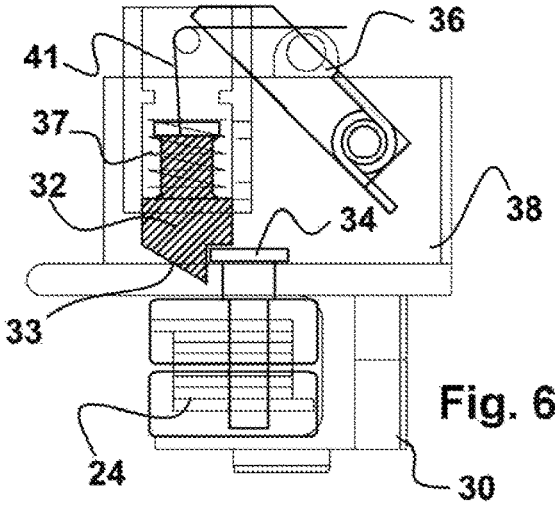

FIG. 6 shows a sectional view through the central portion of the connection member as in 3B, but with the lever rotated to a second position adapted to maintain the connection between the first connector and second connector on deployment of the body of the spike strip from the housing.

Figure 7:
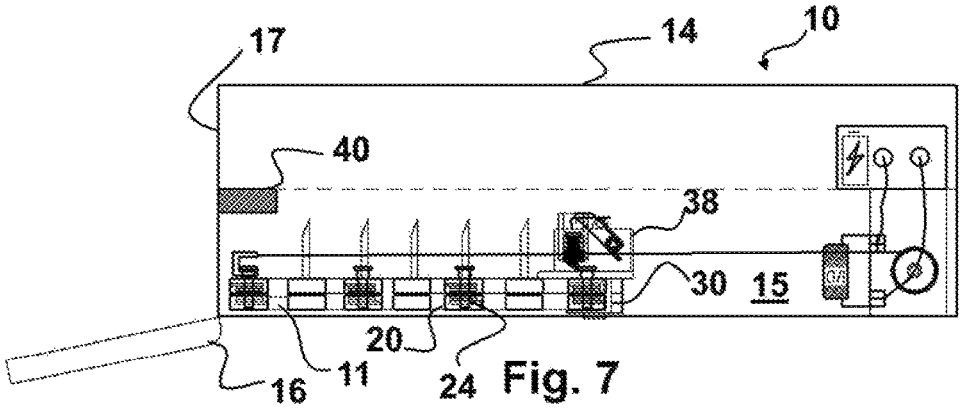

FIG. 7 is a sectional view showing the device with the lever in the position of FIG. 6, wherein the lever is out of position for contact with a bumper in the housing.

Figure 8:
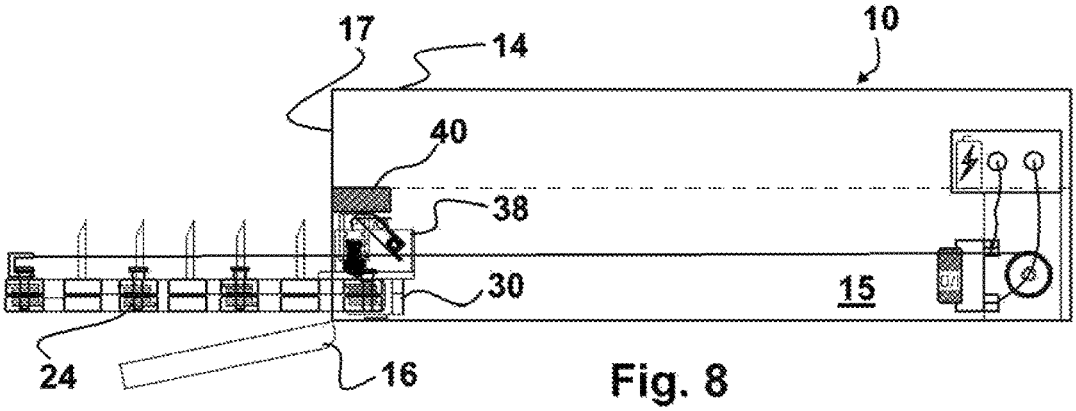

FIG. 8 shows the body of the spike strip extending from the housing, but with the first connector on the connecting member remaining in engagement to the second connector on the body of the spike strip.

Figure 9:
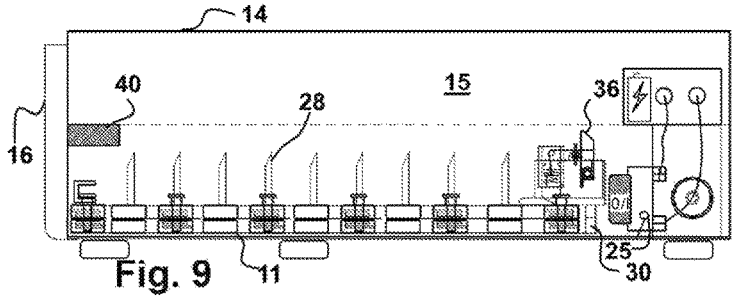

FIG. 9 shows another mode of the device having the connecting member abutting the trailing end of a body of the spike strip which is held in the housing by a door resisting the expansion of the strip from the plurality of springs thereon.

Figure 10:
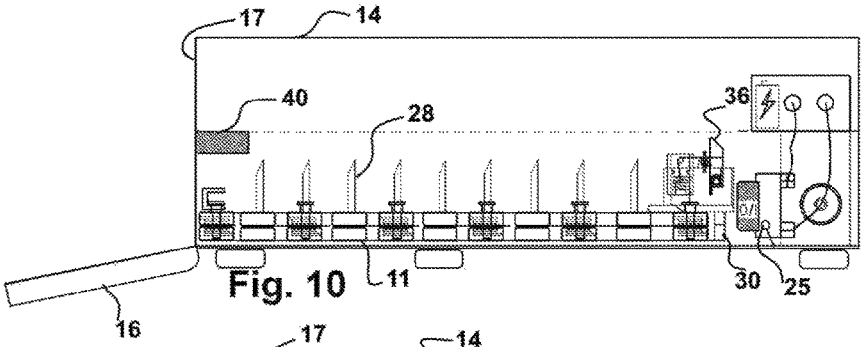

FIG. 10 shows the device as in FIG. 9, wherein a trigger actuated by a solenoid has released and opened the door to the cavity in the housing, removing the restraint against the compacted body of the spike strip.

Figure 11:
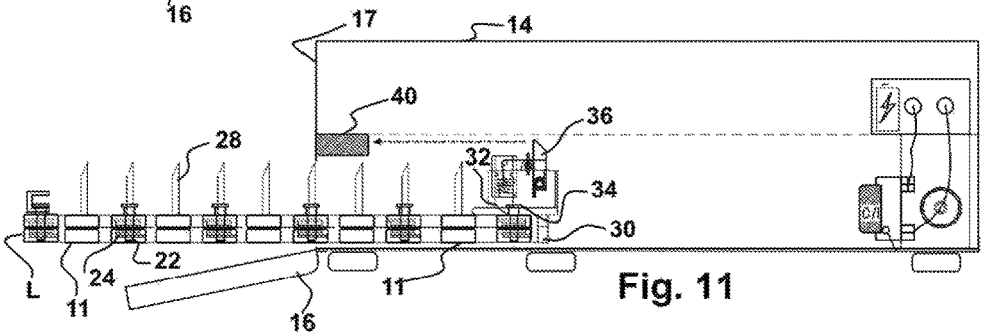

FIG. 11 shows the body of the spike strip ejecting from the cavity in the housing from the force of the plurality of springs engaged to the pivoting engagements on the body.

Figure 12:
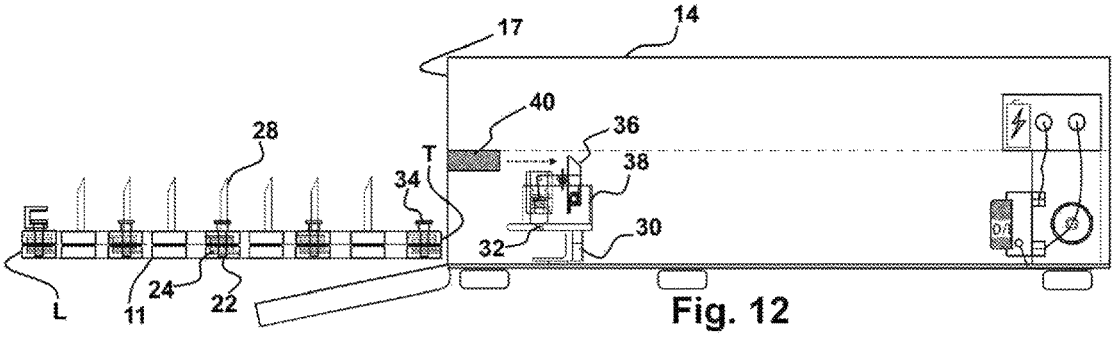

FIG. 12 shows the shows the lever in the first position as in FIG. 11, having rebounded from contact with the bumper thereby causing the release of the first connector on the connecting member from the second connector at the trailing end of the body of the spike strip.

Figure 13:
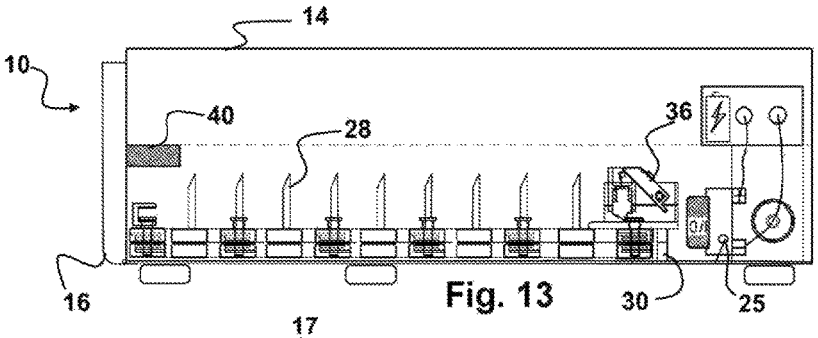

FIG. 13 shows the device as in FIG. 9, but with the lever in the second position out of alignment with the bumper.

Figure 14:
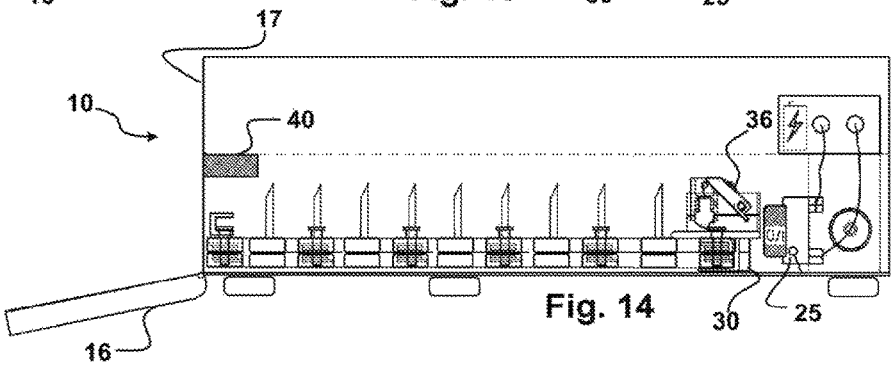

FIG. 14 shows the device where the door has been opened by actuation of a solenoid or trigger, thereby releasing the body of the spike strip to expand and eject from the cavity in the housing.

Figure 15:
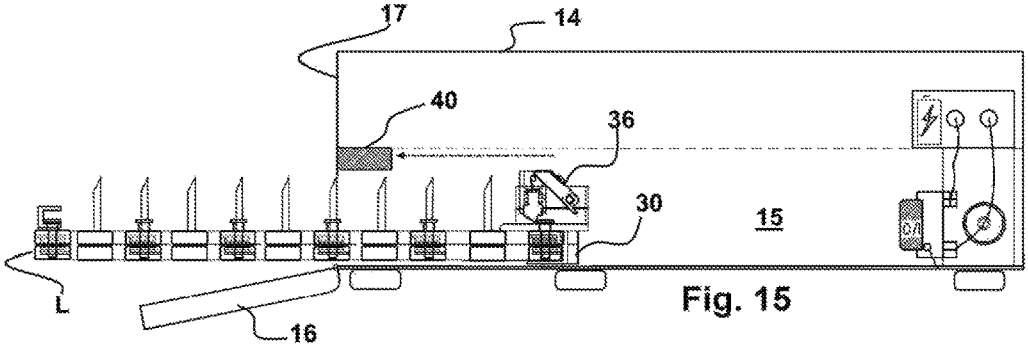

FIG. 15 depicts the body of the spike strip being ejected from the housing by the force of the rotating pivots under pressure from engaged springs, and showing the level in the second position out of alignment with the bumper.

Figure 16:
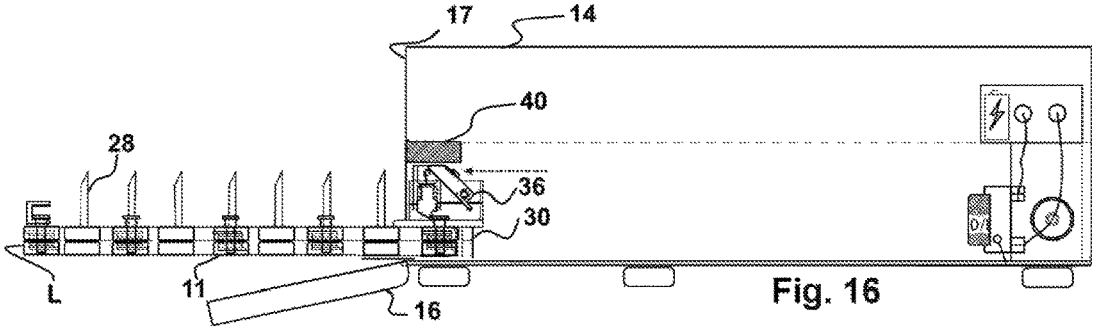

FIG. 16 shows the device ejecting both the body of the spike trip along with the engaged connecting member at the trailing end.

Figure 17:
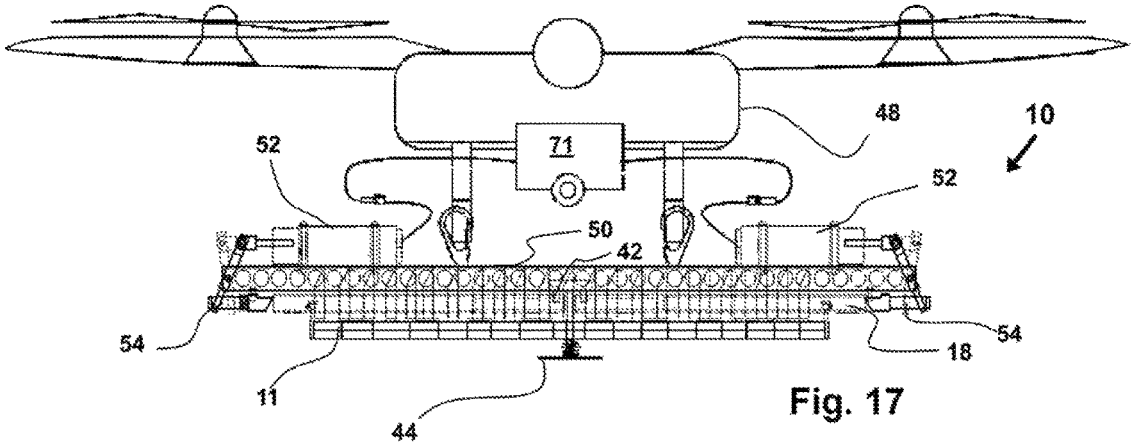

FIG. 17 depicts a mode of the device, where connector on a drone or helicopter member is employed to hold a restraining member engaged to hold the body in a compressed configuration ready for deployment.

Figure 18:
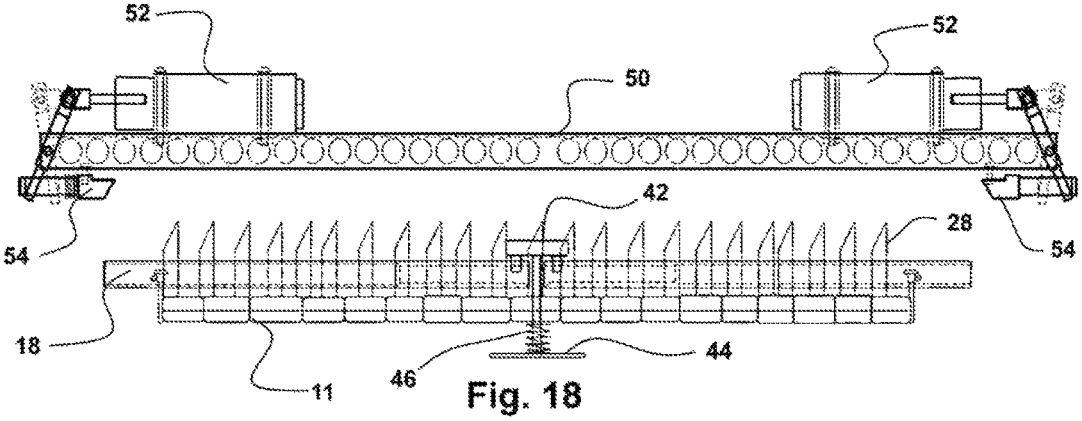

FIG. 18 depicts a release of the body of the spike strip still held in a collapsed state by the restraining member and showing a trigger member.

Figure 19:
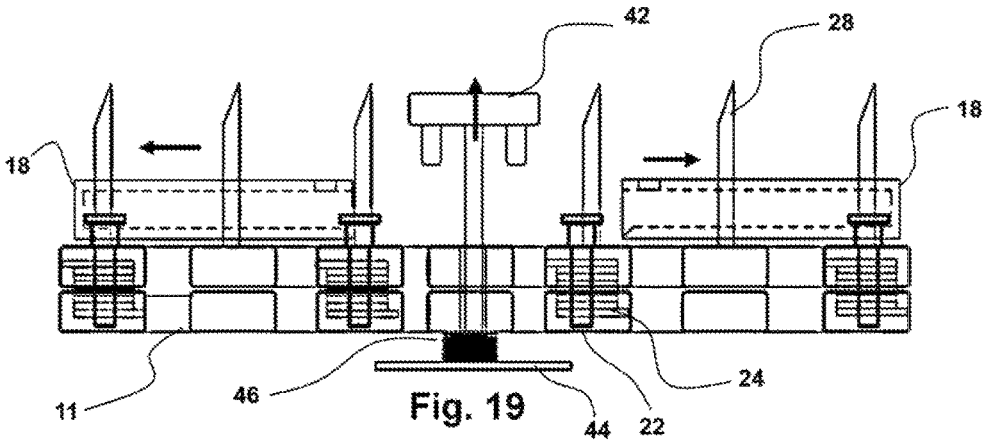

FIG. 19 depicts the device as in FIG. 18, where the trigger member has contacted the roadway surface, and released a connection between two halves of the retraining member, thereby allowing the body to expand to a deployed configuration such as in FIG. 2A, from the collapsed state of FIG. 18.

Figure 20:
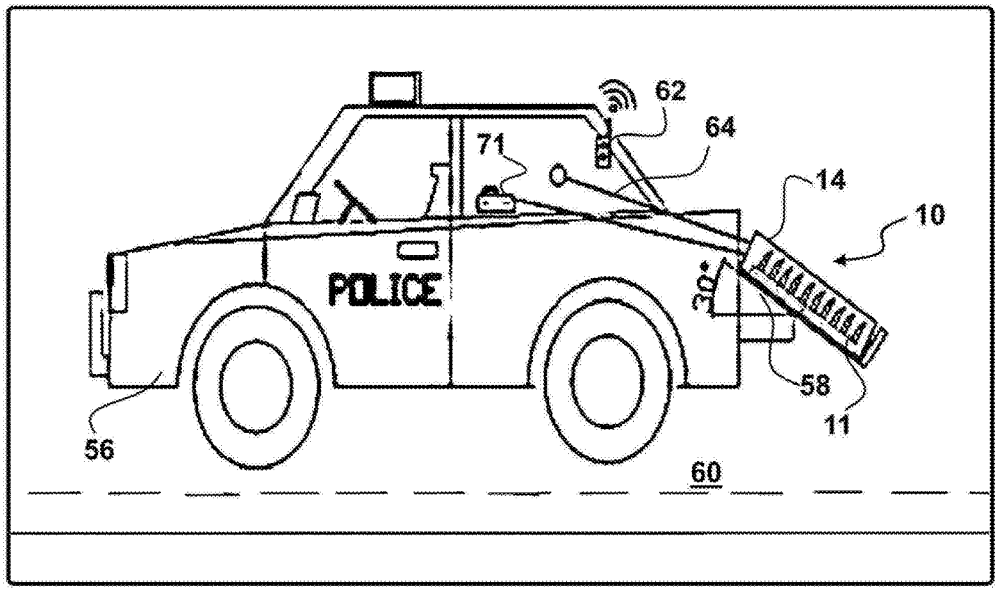

FIG. 20 shows a mode of the device such as in FIG. 2, 9, or 13, where the housing is deployable from a vehicle by a tiling mechanism for positioning on the roadway, and which may be remotely triggered to release or triggered concurrently by a trip wire.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-20, wherein similar components are identified by like reference numerals, there is seen in FIG. 1, an overhead plan view of the device 10 having a restraint holding it in the collapsed position. The device 10 may have any of a number of differing restraints to hold the spike strip 11 in the collapsed position of FIG. 1, from a group including a cable 12, a housing 14 (FIG. 4-12) with a releasable door 16, or a restraining member 18 as in FIGS. 17-19, so long as the restraint may be released remotely to allow the spike strip 11 to expand to the elongated position of FIG. 2A.

In all modes of the device 10 herein, a particularly preferred mode of the spike strip 11 is configured with a scissor arm assembly, shown in FIGS. 1 and 2A, formed by a plurality of strip members in pivoting engagements 22 where a plurality of those pivoting engagement 22, have a spring 24 engaged to bias the spike strip 11 from the collapsed position such as in FIGS. 1-2 to the elongated position of FIG. 2A.

As shown in FIG. 1, the restraint may be a cable 12 which is wound on a powered spool 26 which may be driven by a motor 27. The motor 27 is operatively connected to the spool 26 such that it may be driven to wind the cable 12 onto the spool 26 and to thereby provide a releasable restraint to hold the spike strip 11 in the collapsed position by the tension of the cable 12. The motor 27 may be driven in an opposite direction to release the tension of the cable 12 on the spike strip 11, and allow it to expand to the elongated position of FIG. 2A, from being restrained in the collapsed position of FIGS. 1 and 2 for example.

As can be seen in side views of FIGS. 4-16 of the spike strip 11, pointed hollow spikes 28 are positioned upright on the spike strip 11 and once ejected from the restraint, the spikes 28 will be upright on the roadway surface with the spike strip 11 in the elongated position such as in FIG. 2A. As can also be better seen in FIGS. 4-16, but is common to all modes of the spike strip 11, torsion style springs 24 engaged at the pivoting engagements 22 of the strip members 20, will be compressed with the spike strip 11 in the collapsed position, and once the restraint is released, will cause the spike strip 11 to immediately move to the elongated position, thereby deploying it.

The beginning of such a deployment is shown in FIG. 2 where the restraint provided by the cable 12 holding the spike strip 11 collapsed, has been released causing the spike strip 11 to eject from the housing 14 such as shown in FIG. 2A, by expanding where the leading end "L" of the spike strip 11 will start to project from the housing 14 because the trailing end "T" will be restrained from doing so by the connecting member 30 which is in contact with a component at the rear of the housing 14, thereby forcing the spike strip 11, to expand under force from the springs 24 in a direction at the leading end L. This is the common mode of ejection onto the roadway for all modes of the device 10 herein.

Also common to all modes of the device 10 herein, is the employment of the connecting member 30, which has a first connector 32 thereon which can either be engaged with and set to release from a second connector 34 at the trailing end T, of the spike strip 11, or can be set disengaged from the second connector 34. In either connective position, the connecting member 30 with the first connector 32 centrally located or centered thereon, provides for an easy engagement of the trailing end T of the spike strip 11, and subsequent movement to the collapsed position, for the user, which will always center the spike strip 11 within the housing 14 or within the other restraint holding it to the collapsed position.

As noted herein, besides providing a centering component for the spike strip 11, during movement to the collapsed position and re-arming of the device 10, the ability to set a trigger member 36 operatively engaged to a projection 38 extending from a top surface of the connecting member 30, allows the user great utility. When set in a first position shown in FIG. 3B, the spike strip 11 will be caused to disconnect from the housing 14, by rotation of the trigger member 36 which will disconnect the first connector 32 from the second connector 34 on the spike strip 11, as it is expanding to the elongated position. Currently such is actuated by the trigger member 36 set to the first position of FIG. 3B, where it will impact a bumper 40 during ejection of the spike strip 11, and will cause the first connector 32 to rise and disconnect from the second connector 34.

As shown in FIGS. 3B and 6, a flexible member 41 causes the actuation of the first connector 32 to relate from the second connector 34, but any actuation means as would occur to those skilled in the art may be employed. However, the use of the bumper 40 impacting against the trigger member 36, during ejecting movement of the spike strip 11 has been shown to be especially effective, as it also keeps the connecting member 30 in the housing 14, and ready for re-engagement with the trailing end T of the spike strip 11.

When moved to a second position shown in FIG. 6, the trigger member 36 is placed out of position to impact the bumper 40 during the ejection sequence of the expanding spike strip 11. In this positioning, the trigger member 36 will not be actuated by impact with the bumper 40. Thus, the first connector 32 remains in connection with the second connector 34, and the connecting member 30, which is longer than a width of the opening 17 covered by the door 16, will impact the opening end of the housing 14 while engaged to the trailing end T, of the spike strip 11, while it is expanding to the elongated position of FIG. 2A. The connecting member 30 will thus hold the trailing end T of the spike strip 11, engaged to the connecting member 30 during elongation, and thus adjacent it. This works well for an adjacent lane deployment in the roadway.

This ability to set the trigger member 36 to either actuate and disconnect the connecting member 30 from the spike strip 11, or not actuate and remain connected to the spike strip 11, affords the device 10 great utility. In modes using a cable 12 as the restraint, with the cable 12 may be wound once the spike strip 11 has ejected from the housing 14, and be automatically retrieved and repositioned to the collapsed position ready for redeployment by release of the spool 26 to free-wheel, or by rotation of the spool 26 by the motor 27 to allow a fast expansion of the spike strip to the elongated position which ejects it from the housing 14 under the force of the multiple springs 24 compressed at the pivoting engagements 22.

Further, in instances where the spike strip 11 must deploy a long distance across the roadway, setting the trigger member 36 to the first position to release the connecting member 30 from the spike strip 11, where the connecting member 30 remains in the housing 14, and the spike strip is free to eject and elongate, has been found in experimentation to allow the spike strip 11 to eject and deploy a much further distance further from the housing 14, such as across a first lane of a highway and into a second lane. Thus the trigger member 36, may be set by a user for the task at hand of deployment in a lane immediately adjacent the housing 14, a deployment to a second lane, spaced a good distance from the housing 14. Such a disconnection from the connection member 30 is shown in FIG. 2A, where the expanding elongated spike strip 11 will continue movement away from the housing 14, once disconnected from the connecting member 30 which remains within the housing 14 having been restrained by the opening 17 which is slightly narrower than the width of the connecting member 30.

Shown in FIG. 3 is a top plan view of the connecting member 30 herein, showing the centrally located first connector 32 and an opening 35 sized to slide the second connector 24 therein into engagement with the first connector 32 and be held in that engagement by the biasing force of the connector spring 37 shown in FIG. 3B. In all modes of the device 10 employing the housing 14, where the spike strip 11 is restrained by a cable 12 or by the door 16 and housing 14, the second connector 34 on the spike strip 11 is easily engaged with the first connector 32 on the connecting member 30, by sliding in the opening 35 and against the declining edge 33 of the first connector 32 which will lift it while the force overcomes the connector spring 37, and then engage the first connector 32 with the second connector 34.

As can be seen in FIG. 4 in the side view shown, the trigger member 36 is set to the first position, to contact the bumper 40 and release the first connector 32 on the connecting member 30, from the second connector 34 on the spike strip 11. As shown in FIG. 5, this allows for the ejection of the spike strip 11 from the housing 14, unconnected from the connecting member 30 so it may travel further. The cable 12 providing the restraint in the housing 14 for the spike strip 11, once rewound, will reconnect the first connector 32 to the second connector 34, and pull the engaged connecting member 30 to the rear of the housing 14, and concurrently force the expanded spike strip 11 to the collapsed position such as in FIG. 1.

As noted, FIG. 6 shows a sectional view through the central portion of the connection member 30 of FIG. 3 similar to that of 3B. As shown, trigger member 36 has been moved or rotated to the second position, where it will not impact the bumper 40 on ejection of the spike strip 11 shown in FIG. 7. Thus the connecting member 30 will remain engaged with the spike strip 11 by the engagement between the first connector 32 and second connector 34 on deployment of the spike strip 11 from the housing 14. As noted, this maintains the trailing end T of the spike strip 11, within the cavity 15 of the housing 14 allowing expansion to the elongated position, only to the area adjacent the opening 17 for a length of the spike strip 11, from the trailing end T, to the leading end L. This deployment is shown in FIG. 8. Rewinding the cable 12 as noted, will retrieve and collapse the spike strip 11 into the cavity 15 of the housing 14 where it is held by the restraint until released, which in this case would be the cable 12.

FIGS. 9-12 show the device 10 herein in another mode which includes the connecting member 30 which is restrained within the cavity 15 of the housing 14 by the narrow opening 17, but employs the door 16 and sides of the housing 14 as the restraint to hold the spike strip 11 in the collapsed position of FIG. 9, rather than the cable 12. An actuator 25 engaged to a solenoid or the like and a lock on the door 16 is employable to unlock and cause the door 16 to open.

Other than the use of compression of the collapsed spike strip 11 against the door 16 as the restraint, the device in FIGS. 9-12 works in the same manner as the device of FIGS. 1-8. The connecting member 30 may be left engaged with the trailing end T of the expanding and ejecting spike strip 11, by positioning the trigger member 36 to the second position, missing the contact with the bumper 40, as in FIGS. 13-16. This maintains the trailing end T within the cavity 15 of the housing 14, connected to the connecting member 30.

Alternatively, the expanding and ejecting spike strip 11 may be disconnected from the connecting member 30 by positioning the trigger member 36, to the first position as in FIGS. 9-12, wherein the expanding spike strip 11, will eject entirely from the housing 14 and travel a further distance away, since the trailing end T is no longer connected to the connecting member 30.

FIG. 17 depicts a mode of the device 10, where connector, on a drone or helicopter member, is employed to hold a restraining member 18 engaged with the spike strip 11 in the collapsed configuration. The restraining member 18 is formed of a first and second section as better seen in FIGS. 18 and 19, which are separable to allow the spike strip 11, to expand under force of the springs 24 to the elongated configuration shown for example in FIG. 2A. The two sections of the restraining member 18 are held in a releasable connection by a translatable trigger connector 42 in a first position, shown in FIG. 18.

A translation of this trigger connector 42, as shown in FIG. 19, by positioning a trigger plate 44 upon the road surface, disconnects the first section of the retraining member 18 from the second section of the restraining member 18. Thereafter as with the other modes of the device 10, the springs 24 at the pivoting engagements 22 on the spike strip 11, will cause it to expand to the elongated configuration of FIG. 2A.

Positioning the device 10 in a roadway, locates the trigger plate 44 thereon, where the weight of the spike strip 11 and restraining member 18, will overcome the biasing force of the trigger plate spring 46 thereby moving the trigger connector 42 from engagement with the two sections of the restraining member 18 as in FIGS. 17 and 18, to the disengaged position of FIG. 19.

The mode of the device of FIGS. 17-19, work well when deployed by aircraft, such as a helicopter or drone 48 or other aircraft to which the device 10 is adapted for deployment. This deployment may be from a remote position, where a connector 50 on the helicopter or drone 48, engages with two ends of the restraining member 18. Actuators 52 such as solenoids, will release clamps 54 from the ends of the connecting member 30, depositing the device 10 on the road surface where the trigger plate 44 contacts it, and releases the trigger connector 42 from the two sections of the connecting member 30. The spike strip 11 will then move to the elongated position.

Finally, FIG. 20 shows a mode of the device 10 such as in FIG. 2, 9, or 13, where the housing 14 is adapted for deployment from a vehicle 56. The housing 14 is deployable to the roadway surface, by a tilting mechanism 58 which will cause the housing 14 to slide to a position on the roadway surface 60. The tilting mechanism may be a motor powered ramp, engaged either to the vehicle 56 or to the bottom of the housing 14, which will cause the housing 14 which is positioned to extend from a surface of the vehicle 56, to slide to the roadway 60.

Thereafter, a remote control 62 or trip wire 64 will release the restraint holding the spike strip 11 in the collapsed position, causing it to deploy from the opening 17 in the housing 14, in one of the above noted configurations with or without the cable 12 depending on the configuration. As with the other modes of the device of FIGS. 1-16, the connecting member 30 with either restrain the trailing end T of the spike strip 11 within the cavity 15 of the housing 14, or it will relate when the trigger member 36 contacts the bumper 40.

Finally, the device 10 herein in all modes, can be configured to include an onboard computing component 71 having operative software running in electronic memory, and which is operatively connected to the components of the device 10, in all modes, to deploy the spike strip 11 automatically based on software adapted to deploy the spike strip 11 upon receipt of terrestrial location information from onboard or remote sensors communicating data to the computing component. Such sensors can, for example, be video cameras (not shown but well known) operatively engaged to the device 10 or in a remote location such as an overhead aircraft or satellite, in operative communication with the computing component 71.

Such activation may include automatic deployment of the spike strip 11 from a housing 14 can be actuated by software adapted to the task running in electronic memory of the computing component 71, based on communication from the onboard or remote sensors as to the current location and speed of the vehicle to be disabled by the spike strip 11 for example. Alternatively, such an activation could be deployment of a spike strip 11 automatically from a vehicle 56 to a roadway 60, using video from onboard or overhead-positioned cameras in an aircraft or satellite. Further, such an automatic deployment employing such software adapted to the task and running in memory connected to an onboard computing component 71, can also be employed to drive or fly such a vehicle or aircraft to a deployment position on or adjacent a roadway 60, where disconnection from the vehicle or aircraft, or a contact with the roadway 60 by the device 10, will cause a deployment automatically.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the spike strip invention and method of employment have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A spike strip apparatus, comprising:

a spike strip having a plurality of strip members in pivoting engagements;

said spike strip having a collapsed position and having an elongated position running between a leading end and a trailing end of said spike strip;

a plurality of spikes each having an axial conduit therethrough and mounted to said strip members;

a housing having an interior cavity accessible through an opening;

a door actuable from a closed position covering said opening to an open position;

a restraint having an engaged position maintaining said spike strip in said collapsed position while positioned within said interior cavity;

a connecting member positioned in said interior cavity, said connecting member having a width larger than a width of said opening;

a first connector positioned at a central position of said connecting member removably engaged with a second connector at said trailing end of said spike strip;

said restraint releasable from said engaged position to a disengaged position initiating an expansion of said spike strip to said elongated position;

said expansion of said spike strip to said elongated position imparting an ejection of said spike strip from said cavity; and whereby said spike strip is storable in said collapsed position within said housing, and releasable to said elongated upon a roadway surface with said spikes extending from said strip members in a vertical orientation relative to said roadway.

2. The spike strip apparatus of claim 1 additionally comprising:

a trigger member positioned upon said connecting member;

said trigger member having a first position maintaining said removable connection between said first connector and said second connector upon said ejection of said spike strip from said cavity;

said trigger member having a second position releasing said removable connection between said first connector and said second connector upon said ejection of said spike strip from said cavity; and said trailing end of said spike strip remaining in said removable engagement with said connecting member with said trigger member in said first position, and disconnecting from said connecting member with said trigger member set to said second position.

3. The spike strip apparatus of claim 2 additionally comprising:

a bumper in said cavity in a position for a contact with said trigger member in said first position; and said bumper rotating said trigger member to release said removable connection between said first connector and said second connector upon said ejection of said spike strip from said cavity.

4. The spike strip apparatus of claim 1 additionally comprising:

said restraint being a cable engaged at a first end with a motorized spool and at a second end with said leading end of said spike strip;

said cable held wound on said spool to a first length maintaining said spike strip in said collapsed position while positioned within said interior cavity; and said spool releasable for an unwinding of said cable to an elongated length thereby initiating said expansion of said spike strip to said elongated position.

5. The spike strip apparatus of claim 2 additionally comprising:

said restraint being a cable engaged at a first end with a motorized spool and at a second end with said leading end of said spike strip;

said cable held wound on said spool to a first length maintaining said spike strip in said collapsed position while positioned within said interior cavity; and said spool releasable for an unwinding of said cable to an elongated length thereby initiating said expansion of said spike strip to said elongated position.

6. The spike strip apparatus of claim 3 additionally comprising:

said restraint being a cable engaged at a first end with a motorized spool and at a second end with said leading end of said spike strip;

said cable held wound on said spool to a first maintaining said spike strip in said collapsed position while positioned within said interior cavity; and said spool releasable for an unwinding of said cable to an elongated length thereby initiating said expansion of said spike strip to said elongated position.

7. The spike strip apparatus of claim 4 wherein a winding of said cable from said elongated length to said first length, automatically positions said spike strip within said cavity in said collapsed position.

8. The spike strip apparatus of claim 5 wherein a winding of said cable from said elongated length to said first length, automatically positions said spike strip within said cavity in said collapsed position.

9. The spike strip apparatus of claim 6 wherein a winding of said cable from said elongated length to said first length, automatically positions said spike strip within said cavity in said collapsed position.

10. The spike strip apparatus of claim 1 additionally comprising:

said restraint being the door upon said housing said door actuable between a closed position covering said opening, and an open position exposing said opening; and an actuation of said door to said open position initiating said expansion of said spike strip to said elongated position.

11. The spike strip apparatus of claim 2 additionally comprising:

said restraint being the door upon said housing said door actuable between a closed position covering said opening, and an open position exposing said opening; and an actuation of said door to said open position initiating said expansion of said spike strip to said elongated position.

12. The spike strip apparatus of claim 3 additionally comprising:

said restraint being the door upon said housing said door actuable between a closed position covering said opening, and an open position exposing said opening; and an actuation of said door to said open position initiating said expansion of said spike strip to said elongated position.

13. The spike strip apparatus of claim 1 additionally comprising:

said spike strip in a connection with an aircraft such as a helicopter;

said restraint being a restraining member having a first section and a second section;

a trigger member having a first position removably engaged to said first section of said restraining member and said second section of said restraining member;

said trigger member having a second position releasing said first section of said restraining member from said second section of said restraining member;

a release for said connection with said spike strip to said aircraft; and actuation of said release causing a contact of said spike strip upon said roadway surface, whereby a force from a weight of said spike strip communicated to said trigger member translates said trigger member from said first position to said second position.

14. The spike strip apparatus of claim 1 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

15. The spike strip apparatus of claim 2 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

16. The spike strip apparatus of claim 3 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

17. The spike strip apparatus of claim 6 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

18. The spike strip apparatus of claim 7 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

19. The spike strip apparatus of claim 12 additionally comprising:

said housing with said spike strip in said collapsed position within said cavity, positionable at a surface location in a motor vehicle;

a tilting mechanism in-between said surface location and said housing; and said tilting mechanism actuable to elevate a first end of said housing and slide said housing to a position on said roadway.

20. The spike strip apparatus of claim 1 additionally comprising:

said spike strip in said collapsed position positionable at a deployment location on or adjacent said roadway surface by a motor vehicle or aircraft.

* * * * *